US005293702A

United States Patent [19]

Miyoshi et al.

[11] Patent Number: 5,293,702

[45] Date of Patent: Mar. 15, 1994

[54] METHOD AND APPARATUS FOR SELECTIVELY ORIENTING SKI BOOT

[75] Inventors: Terumasa Miyoshi; Shinichi Iwama; Yasushi Asai, all of Tokyo, Japan

[73] Assignee: Daiwa Seiko, Higashikurume, Japan

[21] Appl. No.: 82,903

[22] Filed: Jun. 28, 1993

Related U.S. Application Data

[63] Continuation of Ser. No. 748,873, Aug. 23, 1991, abandoned.

[30] Foreign Application Priority Data

Sep. 7, 1990 [JP] Japan ..... 2-94364[U]

[51] Int. Cl.[5] ..... A43B 5/04

[52] U.S. Cl. ..... 36/117; 36/15; 36/132

[58] Field of Search ..... 36/117, 118, 119, 120, 36/121, 132; 280/611, 613, 614, 615, 623

[56] References Cited

U.S. PATENT DOCUMENTS

| | | | |
|---|---|---|---|
| 3,677,567 | 7/1972 | Salomon | 36/117 X |
| 4,078,322 | 3/1978 | Dalebout | 36/10 X |
| 4,372,062 | 2/1983 | Tringali | 36/117 X |
| 4,499,674 | 2/1985 | Olivieri | 36/117 |
| 4,937,955 | 7/1990 | Bonaventure | 36/117 X |
| 4,945,659 | 8/1990 | De Marchi et al. | 36/120 X |
| 4,982,515 | 1/1991 | Sartor | 36/117 |
| 5,054,213 | 10/1991 | Bonaventure | 36/117 |
| 5,086,575 | 2/1992 | Bonaventure | 36/117 |
| 5,090,139 | 2/1992 | Germanni | 36/119 X |
| 5,214,865 | 6/1993 | Sartor | 36/132 X |

FOREIGN PATENT DOCUMENTS

| | | | |
|---|---|---|---|
| 3225336 | 2/1983 | Fed. Rep. of Germany | 36/117 |
| 58-81001 | 5/1983 | Japan . | |

*Primary Examiner*—Paul T. Sewell
*Assistant Examiner*—Beth Anne Cicconi
*Attorney, Agent, or Firm*—Longacre & White

[57] ABSTRACT

A ski boot having a boot body having a bottom surface and boot soles attached to the bottom surface of the boot body. The soles and boot bottom surface include attaching members for changing the attaching position of the soles with respect to the boot body in a foot-width direction. The repositioning of the sole with respect to the boot body is used for selectively altering the lateral position and/or longitudinal alignment and/or the cant orientation of the ski boot and skier's foot with respect to the ski board.

6 Claims, 8 Drawing Sheets

METHOD AND APPARATUS FOR SELECTIVELY ORIENTING SKI BOOT

This is a continuation of application Ser. No. 07/748,873, filed Aug. 23, 1991, which was abandoned upon the filing hereof.

BACKGROUND OF THE INVENTION

A. Field of the Invention

The present invention relates to a ski boot. More particularly, the present invention relates to a ski boot in which a sole of the boot which is secured to the ski board is adjustably attached to a boot body.

B. Description of the Prior Art

A conventional ski boot having a foot holding mechanism in which a front instep of the foot is held against and secured to an outer shell of the ski boot in order to reduce slack existing between the foot inserted into the ski boot and the ski boot shell. This fit is necessary to get a good feeling in which the foot is suitably fitted to the ski boot. Such a boot has been developed and is disclosed in the Japanese Patent Application (OPI) No. 81001/83.

In such a conventional ski boot, an adjustable buckle is rotatably mounted on the front instep of the outer shell and a movable member is engaged with the adjustable buckle. In addition, a tightening strap for pushing the instep of the foot is located between the outer shell and the inner boot in the instep width direction of the boot. One end of the tightening strap is secured to the movable member and the other end of it is secured to the outer shell of the boot.

With respect to such a conventional ski boot, when the adjustable buckle is urged so as to surround the outer portion of the boot to apply the tensile force to the tightening strap, the tightening strap equally pulls on the front instep, thereby reducing the slack between the foot and the ski boot. The elimination of slack obtains a better feeling in which the foot is suitably fitted to the ski boot, and enhances operational efficiency and control of the ski.

However, in such a conventional ski boot, when the adjustable buckle surrounds the outer portion of the ski boot to push against the front instep of the foot, the instep of the foot is drawn toward the inside or outside of the boot shell, whereby the center of the skier's foot is shifted with respect to the center of the ski boot or the associated ski board. Accordingly, there is a problem in that the weight of the skier in accordance with these various circumstances cannot be properly and naturally transmitted to the ski board, whereby it is not easy to control an edging force of the ski board with respect to the snow surface.

Also, in the case where the center of the foot of skier is corresponded with that of the ski boot and ski board, there is still the problem that the delicate edging force necessary for the circumstances of skiing particular terrain and certain snow conditions, slope, cannot be appropriately applied by the skier. In this instance, it has been impossible to apply a variety of changes in correspondence between the foot, boot, and ski board to compensate for the above mentioned circumstances and to assist the skier.

SUMMARY OF THE INVENTION

The present invention was made in order to solve the above-mentioned problems.

Accordingly, it is an object of the present invention to provide a ski boot in which the attaching relative positions of the boot sole with respect to the boot body can be changed so that the corresponding fixing positions of the boot body with respect to the underlying ski board can be changed. In this manner, the operational efficiency of the ski board is enhanced.

It is another object of the present invention to provide a ski boot in which a cant adjustment can be applied in the case where a user has legs shaped so as to not intersect the ski board at right angles, i.e., legs either bowed inwardly (knees touching) or outwardly (knees not touching).

According to a first aspect of the present invention, a ski boot comprises: a boot body having a bottom surface; and boot soles attached to the bottom surface of the boot body, the soles having attaching members for changing an attaching position of the sole with respect to the boot body in a foot-width direction.

With respect to a second aspect of the present invention, the boot soles described in the first aspect are exchangeably attached to the bottom surface of the boot body and there are many kinds of the boot soles each of which has different attaching positions to the boot body. In this manner a skier may selectively alter the position relationship of the boot and sole by exchanging sole elements.

With respect to a third aspect of the present invention, the attaching member described in the first and second aspects of the invention comprises a plurality of attaching portions, the attaching portions are formed in the foot-width direction, and one of the attaching portions is selected and attached to the boot body.

With respect to a fourth aspect of the invention, a bottom surface of the boot soles described in any of aspects 1 to 3 are formed to be inclined in the foot-width direction.

According to a fifth aspect of the invention, the boot soles described in any of aspects 1 to 4 are attached to a pair of boot bodies so as to be exchangeable from one of either the right and left boot body to the other of the right and left boot body.

With respect to the first aspect of the present invention, since the boot sole secured to the ski board is attached to the bottom surface of the boot body and the attaching position of the sole with respect to the boot body can be changed in the foot width direction, the fixing position of the boot body with respect to the ski board is changeable in the foot width direction.

With respect to the second aspect of the present invention, the boot sole is exchangeably attached to the bottom surface of the boot body. In addition, since there are many kinds of the boot soles whose attaching positions to the boot body are different respectively, the sole attached to the bottom surface of the boot body is exchanged for another sole which has a different attaching position to the boot body, whereby the fixing position of the boot body with respect to the ski board is changed in the foot width direction.

According to the third aspect of the present invention, since a plurality of attaching portions attached to the boot body are formed in the foot width direction and one of the attaching portions is attached to the boot body, the attaching portion attached to the boot body can be changed, whereby the fixing position of the boot body with respect to the ski board is changeable in the foot width direction.

According to the fourth aspect to the present invention, since the bottom surface of the boot sole is formed to be inclined in the foot width direction, so-called cant adjustment can be applied in the case where the user has legs which do not squarely intersect the ski board.

With respect to the fifth aspect of the present ski boot, the boot soles are attached to the boot bodies so as to be exchangeable from one of right and left of boot bodies to the other of right and left boot bodies, whereby the attaching position of the boot sole to the boot body can be changed and the fixing position of the boot body to the ski board is changeable.

Figure 15:
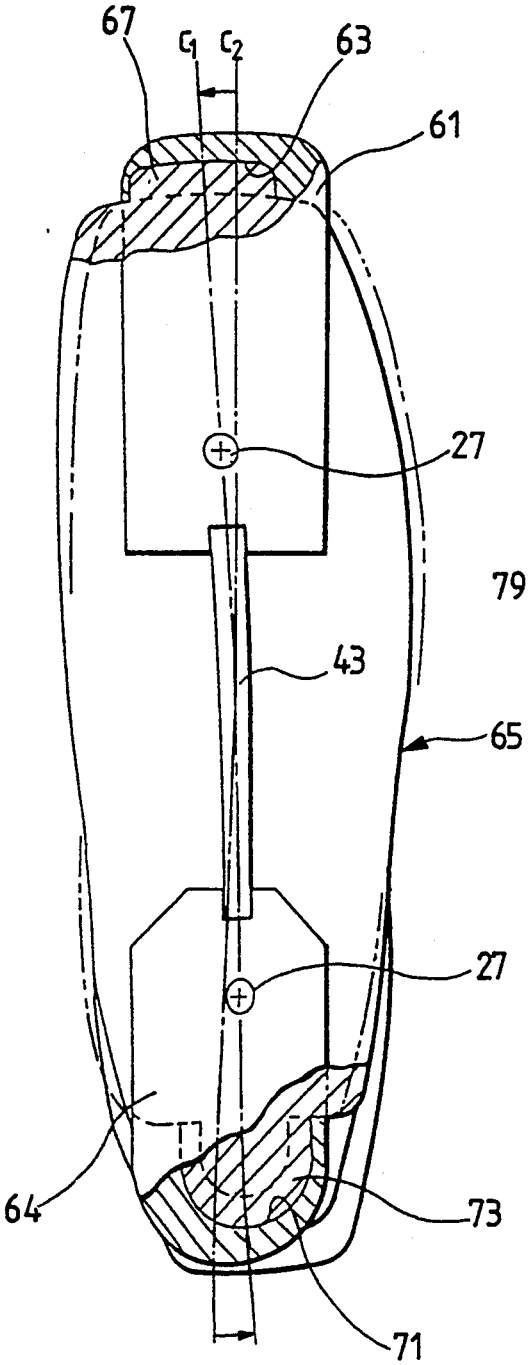
FIG. 15 is a cutaway plan view of the bottom surface of the boot showing another embodiment of the present ski boot.
Figure 16:
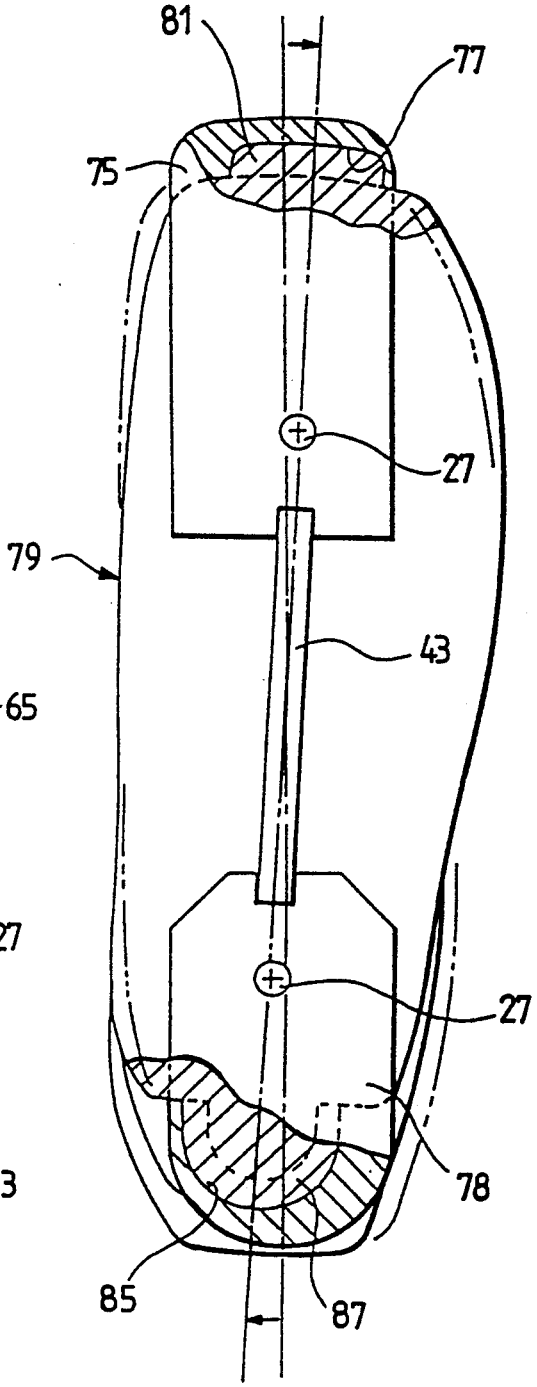
FIG. 16 is a cutaway plan view of the bottom surface of the boot showing another embodiment of the present ski boot.
Figure 18:
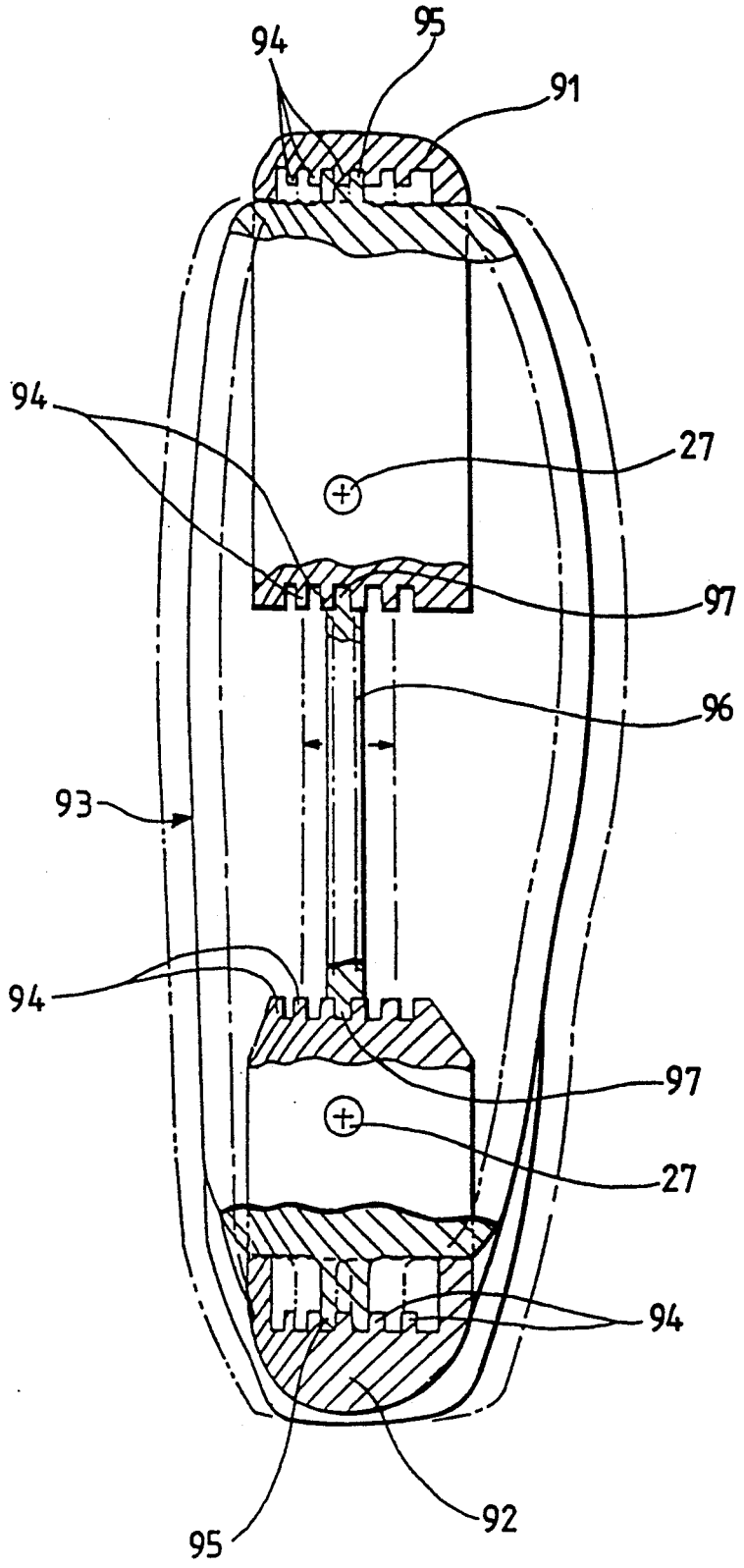
Figure 19:
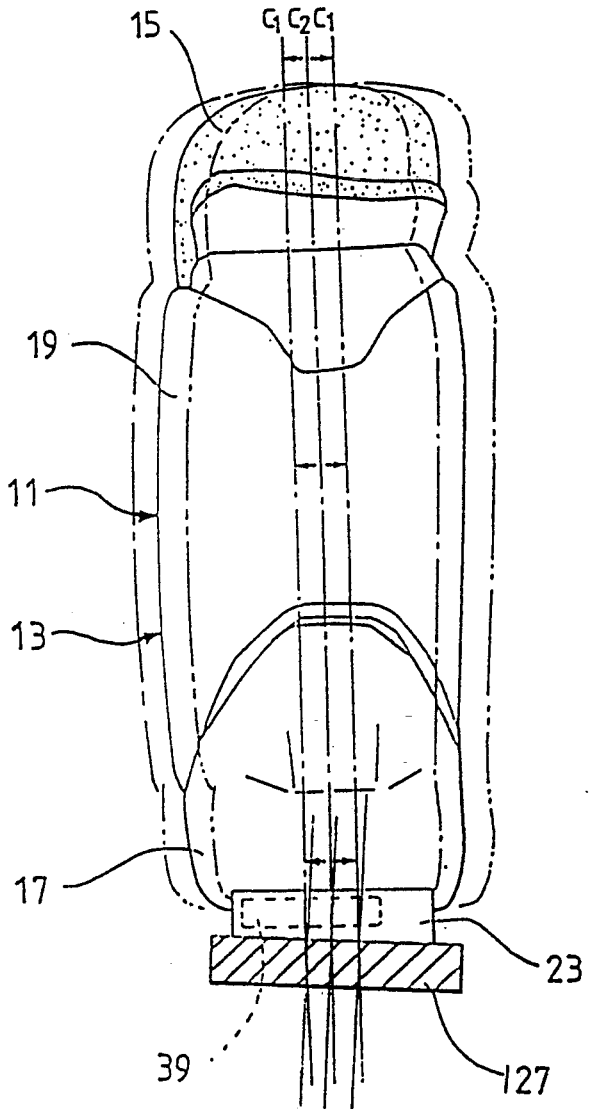

FIG, 17 is a plan view in which the ski boots shown in FIGS. 15 and 16 are attached to the ski board;

FIG. 18 is a cutaway plan view of the bottom surface of a boot in yet another embodiment of the present invention; and, FIG. 19 is a front view of the left side ski boot having an inclined sole.

DETAILED DESCRIPTION OF THE PREFERRED EMBODIMENTS

Embodiments of the present invention are hereinafter described in detail with reference to the drawings attached hereto.

Figure 2:
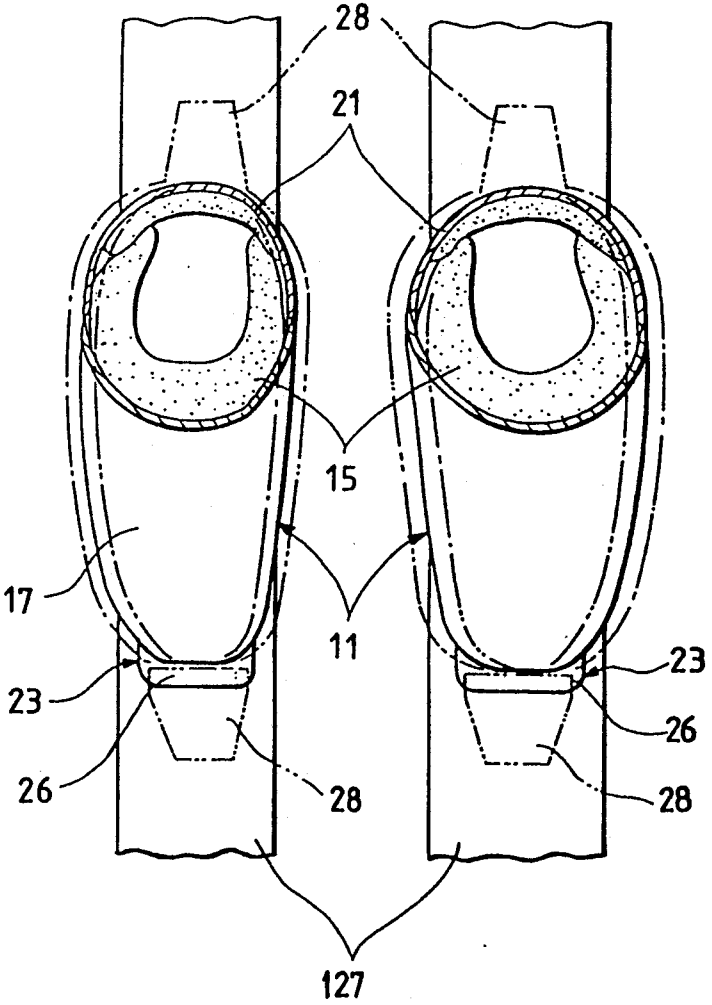
FIG. 2 is a plan view of a pair of ski boots according to the present invention.
Figure 1:
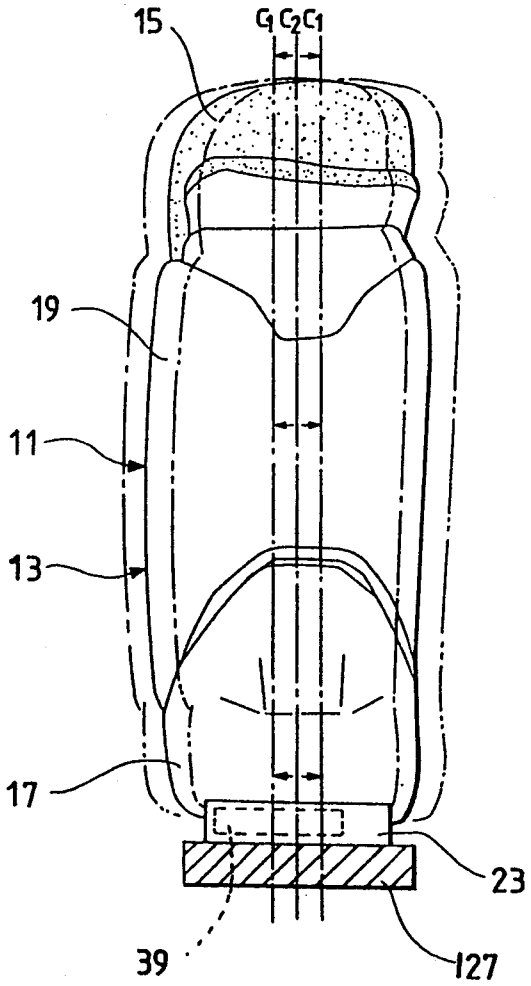
FIG. 1 is a front view of the left side of ski boot which is an embodiment of the present invention.

FIGS. 1 and 2 show a ski boot in an embodiment according to the present invention. The reference numeral 11 generally designates a boot body.

The boot body 11 comprises an outer shell 13 which is made of a hard tenacious synthetic resin and an inner boot 15 which is fittingly inserted into the outer shell 13.

The outer shell 13 comprises a shell body 17 which covers the foot of the user of the boot at and below his or her ankle, a front cuff 19 which covers his or her ankle and shin, and a rear cuff 21 which covers his or her calf above the heel.

Figure 3:
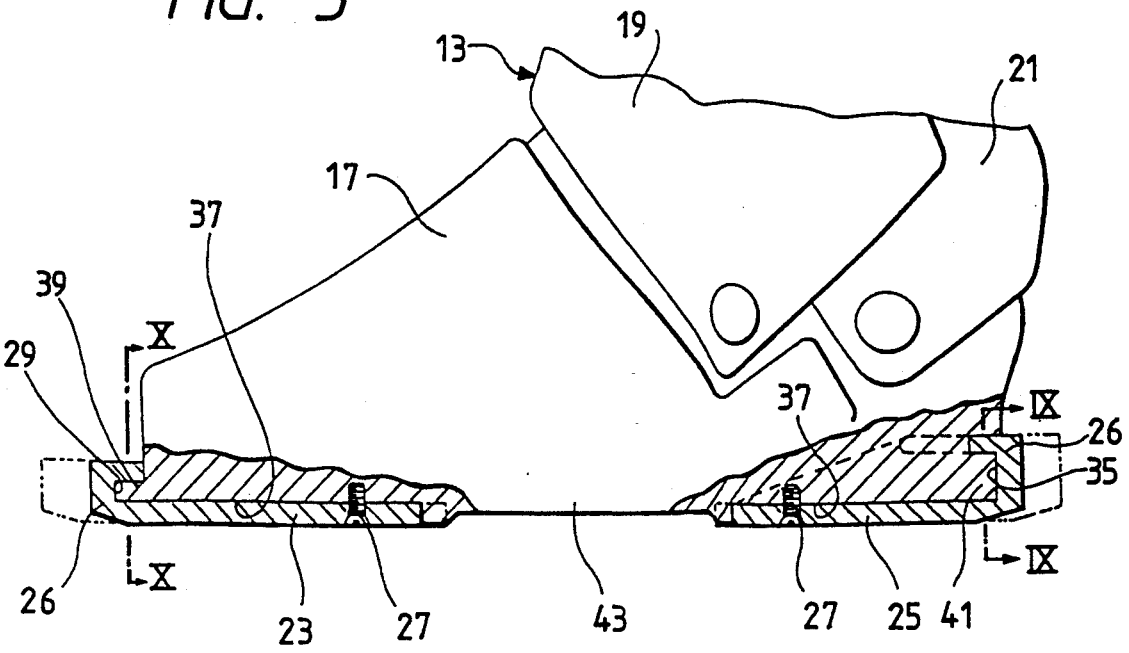
FIG. 3 is a cutaway side view of the boot shell body shown in FIG. 1.

In addition, as shown in FIGS. 1 to 3, a front side sole 23 and a rear side sole 25 are detachably screwed to a bottom surface of the boot body 11, that is, a bottom surface of the shell body 17 by a fastener 27*a*, respectively. Each fixing portion 26 of the boot soles 23 or 25 is fixedly secured to the ski board by a metal fitting (binding) 28 mounted to a ski board 27.

Figure 4:
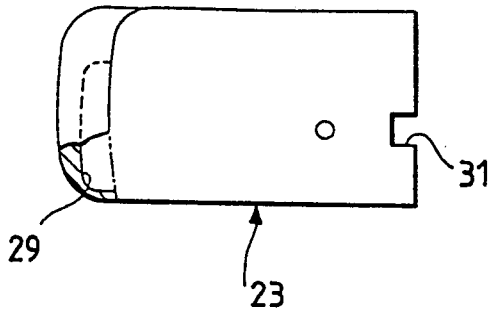
FIG. 4 is a cutaway plan view of a front side sole.

As shown in FIG. 4, an engagement recessed portion 29 is formed to the front end of the front side sole 23, and a notch 31 is formed in and to the rear end of the front side sole 23.

Figure 5:
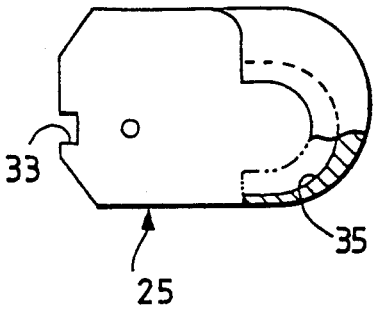
FIG. 5 is a cutaway plan view of a rear side sole.

As shown in FIG. 5, a notch 33 is formed to the front end of the rear side sole 25, and an engagement recessed portion 35 is formed to the rear end of the rear side sole 25.

As shown in FIG. 3, accommodation portions 37 for receiving the front side sole 23 and the rear side sole 25 are formed on or to the bottom surface of the shell body 17 so that the front side sole 23 and rear side sole 25 are received in these accommodation portions 37, respectively. In this manner, the bottom surface of the boot is formed to be integral with the surface of the bottom of shell body 17.

In addition, a front side engagement protruded portion 39 is formed to the front end of the bottom surface of the shell body 17 and a rear side engagement protruded portion 41 is formed to the rear end of the bottom surface of the shell body 17 so that the engagement protruded portions 39 and 41 are inserted to be engaged with the engagement recessed portions 29 and 35 formed to the front side sole 23 and the rear side sole 25, respectively. In this manner, the front side sole 23 and the rear side sole 25 are fixedly secured to the bottom surface of the shell body 17.

Figure 6:
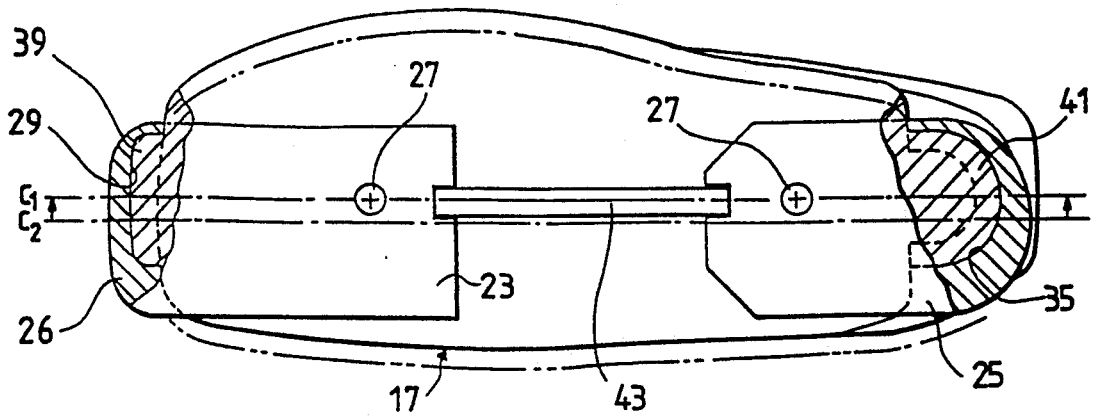
FIG. 6 is a cutaway plan view of a bottom surface of the boot in the case where a center of the sole is shifted to the inside (arch side) with respect to that of the bottom surface of the shell body.

Further, as shown in FIG. 6, a positioning portion 43 is provided along the center of the bottom surface of the shell body 17 in the foot-length direction, and the notch portions 31 and 33 of the front side sole 23 and the rear side sole 25 are engaged with opposite ends of the positioning portion 43. The front side sole 23 and the rear side sole 25 are attached to the shell body 17 in such a manner that the notch portions 31 and 33 are respectively engaged with the positioning portion 43 at the front side or the rear side of the boot body 11 and that the engagement protruded portions 39 and 41 are respectively inserted into the engaging recessed portions 29 and 35, as shown by the two dot and dash line in FIG. 3.

As shown in FIG. 6, the engagement protruded portions 39 and 41 are formed to the center C1 of the bottom surface of the shell body 17 and the engagement recessed portions 29 and 35 of the soles 23 and 25 are shifted to the outside with respect to the center C2 of the front side sole 23 and the rear side sole 25. Due to this construction, the fixing portions 26 (which are clamped to the ski board) of the front side sole 23 and the rear side sole 25 are slightly shifted to the inside with respect to the center C1 of the shell body 17. The boot soles 23 and 25 are always fixedly secured in a constant configuration to the fixed position as shown in FIG. 2 by the fixing metal fittings 28 of the ski board 27. Accordingly, the boot body 1 is fixedly secured and is shifted to the outside with respect to the center of the ski board 27, as shown by the one dot and dash line in FIG. 2.

The skier has available many types of ski boots. For example, in FIG. 7 the skier can have a front side sole 45 and a rear side sole 47 of which the center C2 can correspond to the center C1 of the shell body 17 at the mounting step as shown, or have a front side sole 49 and a rear side sole 51 which are slightly shifted to the outside with respect to the center C1 of the shell body 17 at the mounting step as shown in FIG. 8. In addition, the front side sole 23 and rear side sole 25 can be fixedly secured to the bottom surface of the shell body 17 so as to be slightly shifted to inside with respect to the center C1 of the shell body 17, as shown in FIG. 6.

Figure 9:
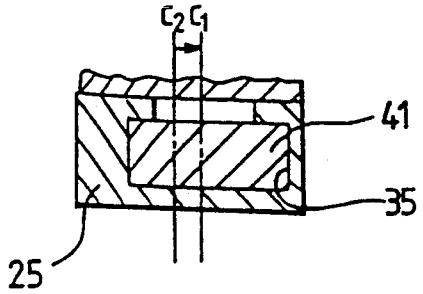
FIG. 9 is a sectional view of the boot along a line IX—IX shown in FIG. 3.
Figure 10:
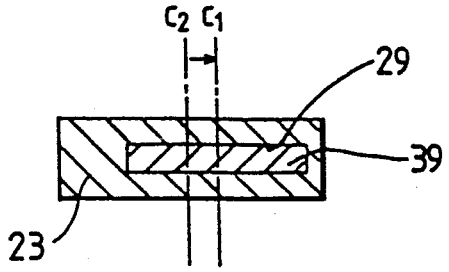
FIG. 10 is a sectional view of the boot along a line X—X shown in FIG. 3.

Accordingly, with respect to the front side sole 23 and the rear side sole 25 fixedly secured to the bottom surface of the shell body 17 as shown in FIG. 6, the engagement protruded portions 39 and 41 formed to the center C1 of the shell body 17 are inserted to be engaged with the engagement recessed portions 29 and 35 which are slightly shifted to the inside with respect to the center C2 of the boots soles 23 and 25 as shown in FIGS. 9 and 10. In this manner, the ski boot for the left foot has taken an outside position with respect to the ski board 27.

Figure 7:
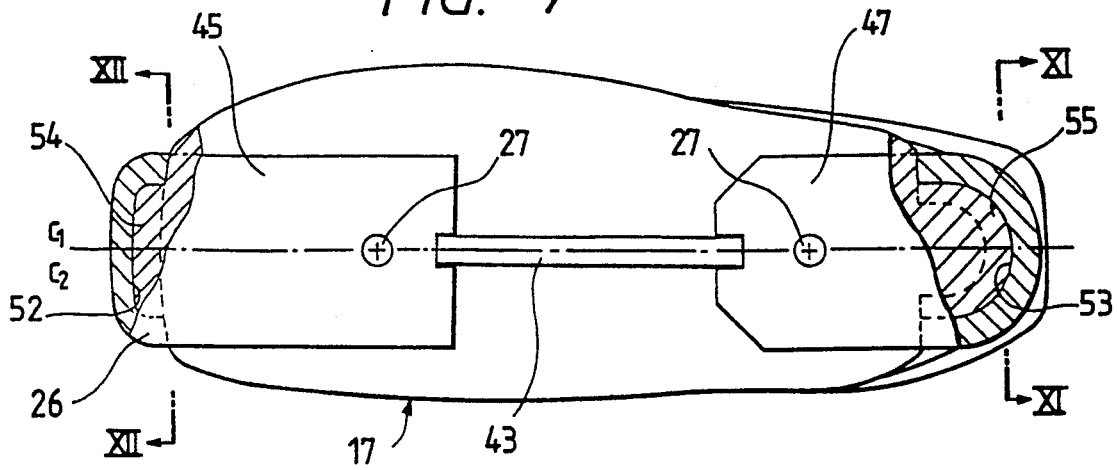
FIG. 7 is a cutaway plan view of a bottom surface of the boot in the case where a center of the sole is corresponded with the center line of the bottom surface of the shell body.
Figure 8:
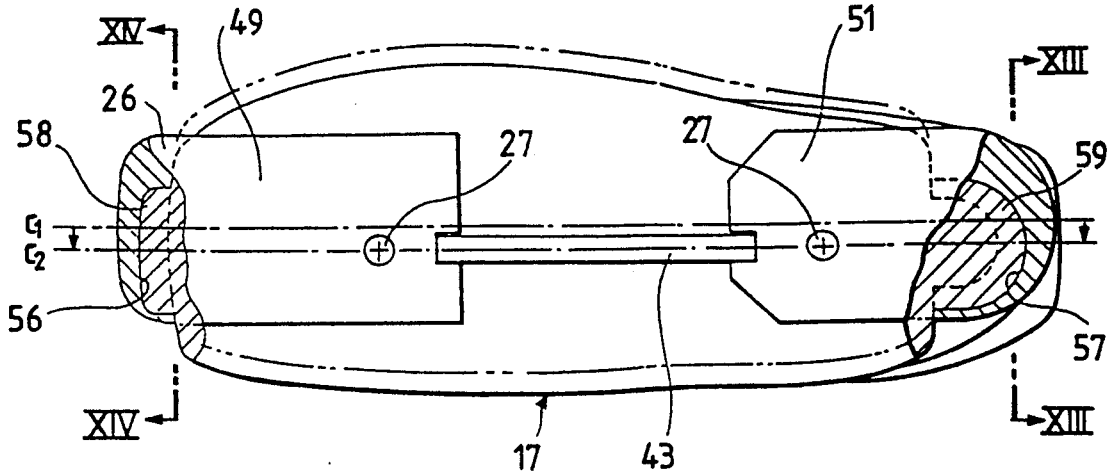
FIG. 8 is a cutaway plan view of a bottom surface of the boot in the case where a center of the sole is shifted to outside with respect to that of the bottom surface of the shell body.
Figure 11:
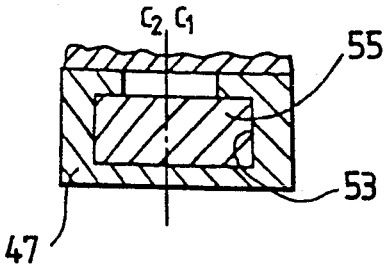
FIG. 11 is a sectional view of the boot along a line XI—XI shown in FIG. 7.
Figure 12:
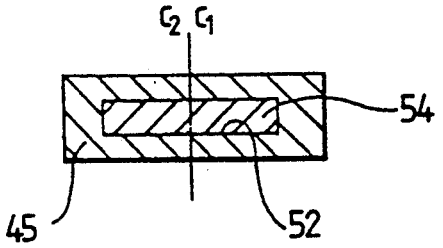
FIG. 12 is a sectional view of the boot along a line XII—XII shown in FIG. 7.

In addition, when the front side sole 45 and the rear side sole 47 are secured to the bottom surface of the shell body 17 as shown in FIG. 7, the engagement protruded portions 54 and 55 formed to the center C1 of the shell body 17 are inserted to be engaged with the engagement recessed portions 52 and 53 formed to correspond to the center C2 of soles 45 and 47 as shown in FIGS. 11 and 12. In this manner, the ski boot for the left foot has taken a center position with respect to the ski board as shown in FIGS. 11 and 12.

Figure 13:
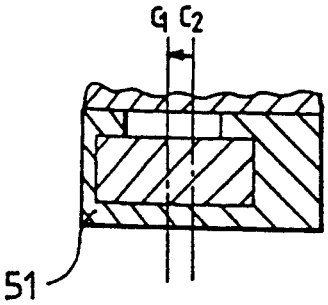
FIG. 13 is a section al view of the boot along a line XIII—XIII shown in FIG. 8.
Figure 14:
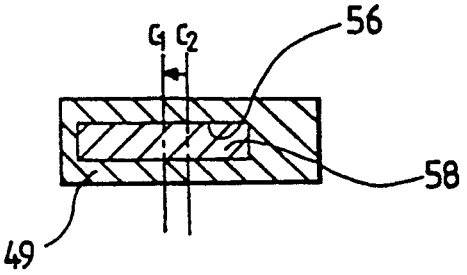
FIG. 14 is a sectional view of the boot along the line XIV—XIV shown in FIG. 8.

Further, when the front side sole 49 and the rear side sole 51 are fixedly secured to the bottom surface of the shell body 17 as shown in FIG. 8, the engagement protruded portions 58 and 59 formed to the center C1 of the shell body 17 are inserted to be engaged with the engagement recessed portions 56 and 57 which are slightly shifted to the outside with respect to the center C2 of the soles 49 and 51 as shown in FIGS. 13 and 14. In this manner, the ski boot for the left foot has taken an inside position to the ski board.

In a pair of ski boots, the boot soles 23, 25, 45 , 47, 49 and 51 are attached to the right and left boot body 11 and are to be exchangeable one to the other.

In a thus constructed ski boot, the front side sole 23 attached to the bottom surface of the boot body 11 can be exchanged for the front side soles 45 and 49 each of which has a different attaching position to the boot body 11. The rear side sole 25 can be exchanged from the rear side soles 47 and 51 each of which has a different attaching position to the boot body In this manner, fixing a desired position of the boot body 11 with respect to the ski board 27 can be accomplished and the foot position with respect to the ski board 27 can be corrected.

Therefore, when the front side sole 23 and the rear side sole 25 are attached to the bottom surface of the shell body 17 as shown in FIG. 6, the ski boot takes an outside position with respect to the ski board 27 as shown by the one dot and dash line in FIGS. 1 and 2, thereby enabling a skier to strongly apply an edging force to the ski board 27 and underlying slope.

In addition, when the front side sole 23 is exchanged for the front side sole 45 and rear side sole 25 is exchanged for the rear side sole 47 as shown in FIG. 7, the fixing position of the boot body 11 with respect to the ski board 27 is changed so that the ski boot takes a center position with respect to the ski board as shown by the solid line in FIGS. 1 and 2. In such a manner a skier is enabled to translate an edging force to the ski board 27.

When the front side sole 23 is exchanged for the front side sole 49 and the rear side sole 25 is exchanged for the rear side sole 51 as shown in FIG. 8, the fixing position of the boot body 11 with respect to the ski board 27 is changed as shown by the two dot and dash line in FIGS. 1 and 2, so that the ski boot takes an inside position with respect to the ski board, thereby weakly applying edging forces through the ski board.

According to the above constructed ski boot, the soles 23 and 25 secured to the ski board 27 are exchangeably attached to the bottom surface of the boot body 17. Since there are many kinds of the soles 23, 25, 45, 47 , 49 and 51 each of which has a different attaching position, the boot soles 23 and 25 attached to the bottom surface of the shell body 17 can be exchanged for the boot soles 45, 47, 49 and 51, whereby the fixing position of the boot body 11 with respect to the ski board 27 is changeable. In addition, when the center of the foot of the skier is shifted with respect to the center of the ski boot or the ski board, the position of the ski boot with respect to the ski board 27 can be easily and simply corrected. As a result, delicate edging forces taking into account the circumstances of the skiing ground such as a snow condition, inclination, and necessary ski board angulation, can be applied because the relative boot and ski board position can be adjusted, thereby enhancing the operational efficiency of the skier.

More specifically, when the soles 23 and 25 which are attached to the ski boot for the left foot shown in FIG. 6, are exchanged for the soles of the ski boot for the right foot, the attaching position of the ski boot with respect to the ski board 27 can be easily changed from the outside position to the inside position. In the same manner, when the boot soles 49 and 51 of the ski boot for the left foot shown in FIG. 8, are exchanged for the boot sole of the ski boot for the right foot, the attaching position of the ski boot with respect to the ski board 27 can be easily changed from the inside position to the outside position.

In the case where the boot body 11 is fixedly secured along the ski board but the foot is obliquely received in and to the boot body 11, an offset between the center of the skier's foot and that of the ski boot occurs due to the influence of the foot shape of the skier and the compelling hold by a fastening apparatus and the like which holds the skier's foot in the boot.

FIG. 15 shows the second embodiment of the present invention. In this embodiment, an engagement recessed portion 63 of a front side sole 61 in the ski boot for the left foot is slightly shifted to the inside with respect to the center of the ski board. That is, the center C2 of soles 61 and 64 is shifted so that an engagement protruded portion 67 formed along the center C1 of a shell body 65 is engaged with the engagement recessed portion 63.

With respect to the rear side sole 64, an engagement recessed portion 71 is formed to be slightly shifted to the outside with respect to the center C2 of the soles 61 and 64 so that an engagement protruded portion 73 formed along the center C1 of the shell body 65 is engaged with the engagement recessed portion 71.

In a modification shown in FIG. 16, in contrast to the embodiment shown in FIG. 15, an engagement recessed portion 77 of a front side sole 75 in the ski boot for the left foot is formed to be slightly shifted to the outside with respect to the center of the ski board. That is, the center C2 of boot soles 75 and 78 is shifted so that an engagement protruded portion 81 of a shell body 79 formed along the center C1 of the shell body 79 is engaged with the engagement recessed portion 77.

With respect to the rear side sole 78, an engagement recessed portion 85 is formed to be slightly shifted to the outside with respect to the center C2 of boot soles 75 and 78 so that an engagement protruded portion 87 formed to the center C1 of the shell body 79 is engaged with the engagement recessed portion 85.

Figure 17:
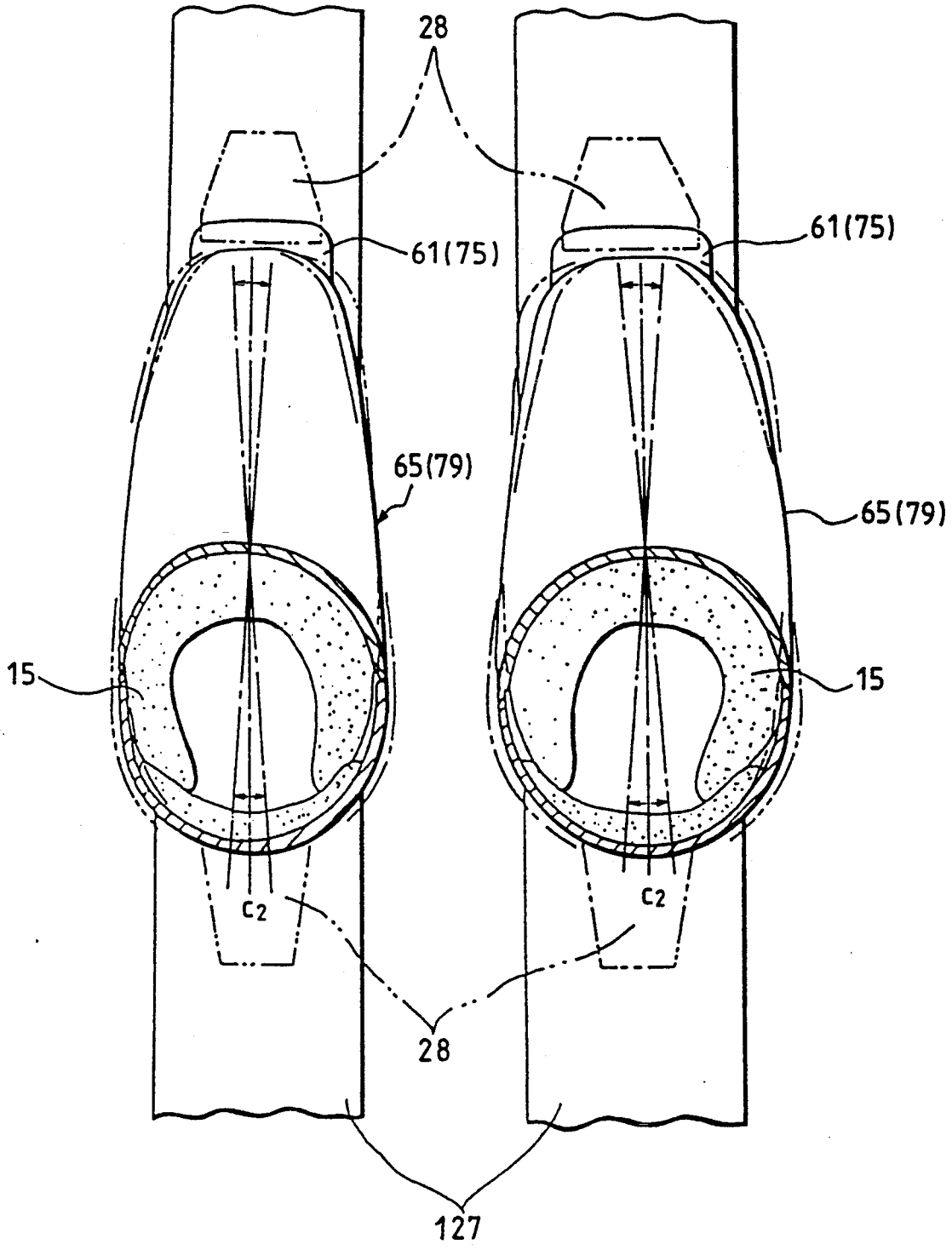

According to a thus constructed ski boot, in the boot soles 61 and 64 shown in FIG. 15, the toe side of shell body 65 is taken to the inside position with respect to the, ski board, as shown by the two dot and dash line in FIG. 17. In addition, in boot soles 75 and 78 shown in FIG. 16, the toe side of shell body 79 is taken to the outside position with respect to the ski board, as shown by the one dot and dash line in FIG. 17.

According to the foregoing embodiments of FIG. 15 and 16, the ski boot can be secured obliquely to the ski board. In this manner, the fixing position of the shell body with respect to the ski board can be changed, and when the center of the skier's foot is shifted with respect to the center of the ski boot, the position of the ski boot to the ski board can be corrected to compensate for this malpositioning of the foot with respect to the ski board. As such, the edging force applied by the skier and taking into account the circumstances of the skiing ground such as the snow condition, the slope, can be adjustably applied, thereby enhancing the operational efficiency of the skier on the ski board.

FIG. 18 designates the third embodiment of the present ski boot. In this embodiment, a plurality of projections are formed to the front and rear of the front side sole 91 and rear side sole 92 of the boot body 93, thereby forming the attaching portions 94. A plurality of engagement recessed portions 95, one of which is engaged with one of attaching portions 94, are formed to the front and rear ends of the boot body 93 so that one of attaching portions 94 is engaged with the respective engagement recessed portion 95.

In addition, engagement protruded portions 97 are formed to both ends of a positioning portion 96 which is formed to the center of the bottom surface of the boot body 93, respectively, whereby the attaching portions 94 which are on the side of the positioning portion 96 of the front side sole or the rear side sole, are engaged with the respective engagement protruded portions 97.

According to the above ski boot embodiment, the attaching portion 94 of the soles 91 and 92 which is engaged with the engagement recessed portion 95 of the bottom body 93 can be changed, whereby the position of the ski boot with respect to the ski board can be quickly and simple altered. Again, the edging force applied by the skier and taking into account the circumstances of the skiing ground such as the snow condition, the slope, can be quickly adjusted, thereby enhancing the operational efficiency of the skier.

In this last embodiment, the fixing position of the boot body with respect to the ski board can be quickly changed without needing spare boot soles for changing attaching positions of the boot body to the ski board.

In the above described embodiments, the attaching positions of the boot soles 23, 45, 49, 61, 75, 91,25, 47, 51, 64, 78 and 92 with respect to the boot bodies 11 and 93 are provided to be changeable in the foot width direction, but the present invention is not confined to the embodiments described above. According to the present invention, so-called cant adjustment in which the bottom surface of the sole is formed to be inclined in the foot width direction, that is, the thickness of the sole, can also be changed, as seen in FIG. 19.

According to one of the above mentioned embodiments, the engagement protruded portions 39 and 41 formed to the front and rear of the shell body 17 are inserted to be engaged with the engagement recessed portions 29 and 35 of the boot soles 23 and 25 so that boot soles 23 and 25 are secured to the bottom surface of shell body 17. However, the present invention is not confined to the embodiments described above, for example, in a reverse or opposite manner the engagement recess portions could also be formed to the front and rear of the shell body and the engagement protruded portions could be inserted to be engaged with the engagement recessed portion of the boot body, whereby the sole is secured to the shell body. In this modification, the same effect as the prior embodiments can be obtained.

With respect to the first aspect of the present ski boot, since the boot sole secured to the ski board is attached to the bottom surface of the boot body and the attaching position of the boot sole with respect to the boot body can be changed in the foot width direction, the fixing position of the boot body with respect to the ski board is changeable in the foot width direction. Accordingly, in the case where the center of the foot of the skier is shifted with respect to the center of the ski boot and the ski board, the fixing position of the ski boot to the ski board can be corrected.

With respect to the second aspect of the present ski boot, the boot sole is exchangeably mounted on the bottom surface of the boot body. Accordingly, since there are many kinds of the boot soles whose attaching positions to the boot body are different respectively, the sole attached to the bottom surface of the boot body can be exchanged for another sole for which the attaching position to the boot body is different, whereby the fixing position of the boot body with respect to the ski board is changed in the foot width direction. Further, when the center of the foot of the skier is shifted with respect to the center of the ski boot and the ski board, the fixing position of the ski boot with respect to the ski board can be corrected.

With respect to the third aspect of the present ski boot, since a plurality of attaching portions attached to the boot body can be formed in the foot width direction of the boot and mounted to the boot body, the attaching portion attached to the boot body can be changed, whereby the fixing position of the boot body with respect to the ski board is changed in the foot width direction. Accordingly, when the center of the skier's foot is shifted with respect to he center of ski boot and ski board, the fixing position of the ski boot with respect to the ski board can be quickly corrected.

With respect to the fourth aspect of the present ski boot, since the bottom surface of the boot sole is formed to be inclined in the foot width direction, so called cant adjustment can be applied in the case where the user has legs and/or feet which require such cant correction.

With respect to the fifth aspect of the present ski boot, the boot soles are attached to the boot bodies so as to be exchangeable from right to left boot bodies. In this manner, the attaching position of the boot sole to the boot body is changed and the fixing position of the boot body to the ski board is changed. Accordingly, when the center of the skier's foot is shifted with respect to the center of the ski boot and ski board, the fixing position of the ski boot to the ski board can be corrected.

What is claimed is:

1. A ski boot comprising:

a boot body having a bottom surface, and defining a longitudinal direction; and boot soles attached to the bottom surface of said boot body, said soles having alignment means for changing an attaching of said soles with respect to said boot body in a foot-width direction which is transverse to said longitudinal direction, said attaching means including a plurality of attaching projections positioned adjacent one another in said foot width direction and extending in said longitudinal direction and engagement recesses positioned adjacent one another, said plurality of attaching projections and engagement recesses are respectively formed in one of said bottom surface and said boot soles, said plurality of attaching projections and engagement recesses variably and selectively engage one another to alter the alignment of said boot soles with respect to said boot body.

2. A ski boot according to claim 1, wherein said boot soles are interchangeably attached to the bottom surface of said boot body, each of said boot soles having a varied shape for altering the attaching position of said boot soles to said boot body.

3. A ski boot according to claim 1, wherein a bottom surface of said boot soles is inclined in the foot-width direction, whereby said boot body is inclined with respect to a ski board.

4. A ski boot according to claim 1, wherein said boot soles are exchangeable from one of a right and left boot body to the other of a right hand left boot body.

5. A method of altering the relative positional relationship of a ski boot which is held against a ski board, with respect to said ski board, comprising the steps of:

removing a boot sole element from an initial alignment on a bottom surface of said ski boot, said boot sole element including attaching means for attaching said boot sole element to said bottom surface, said attaching means including a plurality of attaching projections positioned adjacent one another in a foot width direction and extending in a longitudinal direction and engagement recesses positioned adjacent one another in said foot-width direction, said foot-width direction being transverse to said longitudinal direction, said plurality of attaching projections and engagement recesses are respectively formed in one of said bottom surface and said boot sole element;

replacing said initial alignment of said boot sole element with a second alignment of said boot sole element with respect to said bottom surface, said plurality of attaching projections and engagement recesses being variably and selectively engaged with one another to alter the initial alignment of said boot sole element with respect to said boot in said foot-width direction.

6. The method according to claim 5, wherein a bottom surface of said boot soles is inclined in the foot-width direction, whereby said boot is inclined with respect to a ski board.

* * * * *